United States Patent [19]

Wallace

[11] 4,019,589

[45] Apr. 26, 1977

[54] PULSE MOTOR NUT RUNNER

[75] Inventor: William K. Wallace, Barneveld, N.Y.

[73] Assignee: Chicago Pneumatic Tool Company, New York, N.Y.

[22] Filed: Dec. 2, 1975

[21] Appl. No.: 636,911

[52] U.S. Cl. ..... 173/12; 91/325

[51] Int. Cl.[2] ..... B25B 23/14

[58] Field of Search ..... 173/12; 91/59, 139

[56] References Cited

UNITED STATES PATENTS

| | | | |
|---|---|---|---|
| 2,499,708 | 3/1950 | Whitledge | 91/59 X |
| 3,253,662 | 5/1966 | Sacchini | 173/12 |
| 3,440,928 | 4/1969 | Pauley et al. | 91/59 |

*Primary Examiner*—Ernest R. Purser
*Attorney, Agent, or Firm*—Stephen J. Rudy

[57] ABSTRACT

A non-impacting nut running pneumatic tool in which torque pulses are transmitted by an oscillating air motor through a one-way clutch and reduction gearing to the work. A torque responsive cam clutch member responds to a pre-determined delivered torque to cause stalling of the motor by blocking off escape of exhaust air and to cause discontinuance of further torque transmission to the work by disabling the drive connection. Manually operable adjusting means is provided to regulate the value of torque delivered.

16 Claims, 12 Drawing Figures

PULSE MOTOR NUT RUNNER

BACKGROUND OF THE INVENTION

This invention is concerned with nut running tools of the non-impacting type for transmitting controlled torque to a driven article, such as a nut or bolt, by means of a succession of torque pulses. And its general objective is to provide an improved and practical air driven tool for this purpose.

The tool of the present invention includes a single blade air motor associated with a one-way clutch and operable to oscillate forwardly and reversely so as to deliver through the clutch to the work a succession of torque pulses in a predetermined direction. A torque responsive mechanism associated with a train of reduction gearing connecting the clutch with a final drive spindle cooperates, following delivery by the spindle of a final torque to the work, simultaneously with an air exhaust valve to stall the motor and with releasable latch mechanism to disconnect the drive of the motor from the work. Manipulative means is provided for regulating the torque value at which the torque responsive mechanism is to respond.

A general feature of the invention lies in the general organization and cooperative association of its components, whereby a flow of torque pulses is transmitted to run down the work, and whereby further pulse transmission is automatically terminated following setting of the work to a predetermined torque value.

A desirable advantage of a tool of this improved nature is the relatively small degree of reaction torque returned to the operator as compared with the high degree of torque delivered to the work.

Another feature of the invention lies in the particular structure and mode of operation of the air motor whereby the delivery of torque pulses to the work is achieved.

Another feature lies in the combination of this motor with a one-way clutch whereby the torque pulses are delivered to the work in a single direction and with a momentary time lapse between each pulse whereby the reaction torque returned to the operator is appreciably limited.

A further feature lies in the manner of association of the torque responsive mechanism with an air exhaust control valve and with a releasable latch connection in the drive train whereby, following delivery of a predetermined final torque to the work, the motor is caused to be stalled and simultaneously disconnected from the work.

A still further feature lies in a practical arrangement of manually adjustable means for regulating the torque value at which the torque responsive mechanism is to respond.

The foregoing and other objects, advantages, and features of this invention will appear more fully hereinafter from a consideration of the detailed description which follows, taken together with the accompanying drawings.

BRIEF DESCRIPTION OF THE DRAWINGS

In the accompanying drawings.

DESCRIPTION OF PREFERRED EMBODIMENT

Figures 1, 2, 3, 4:
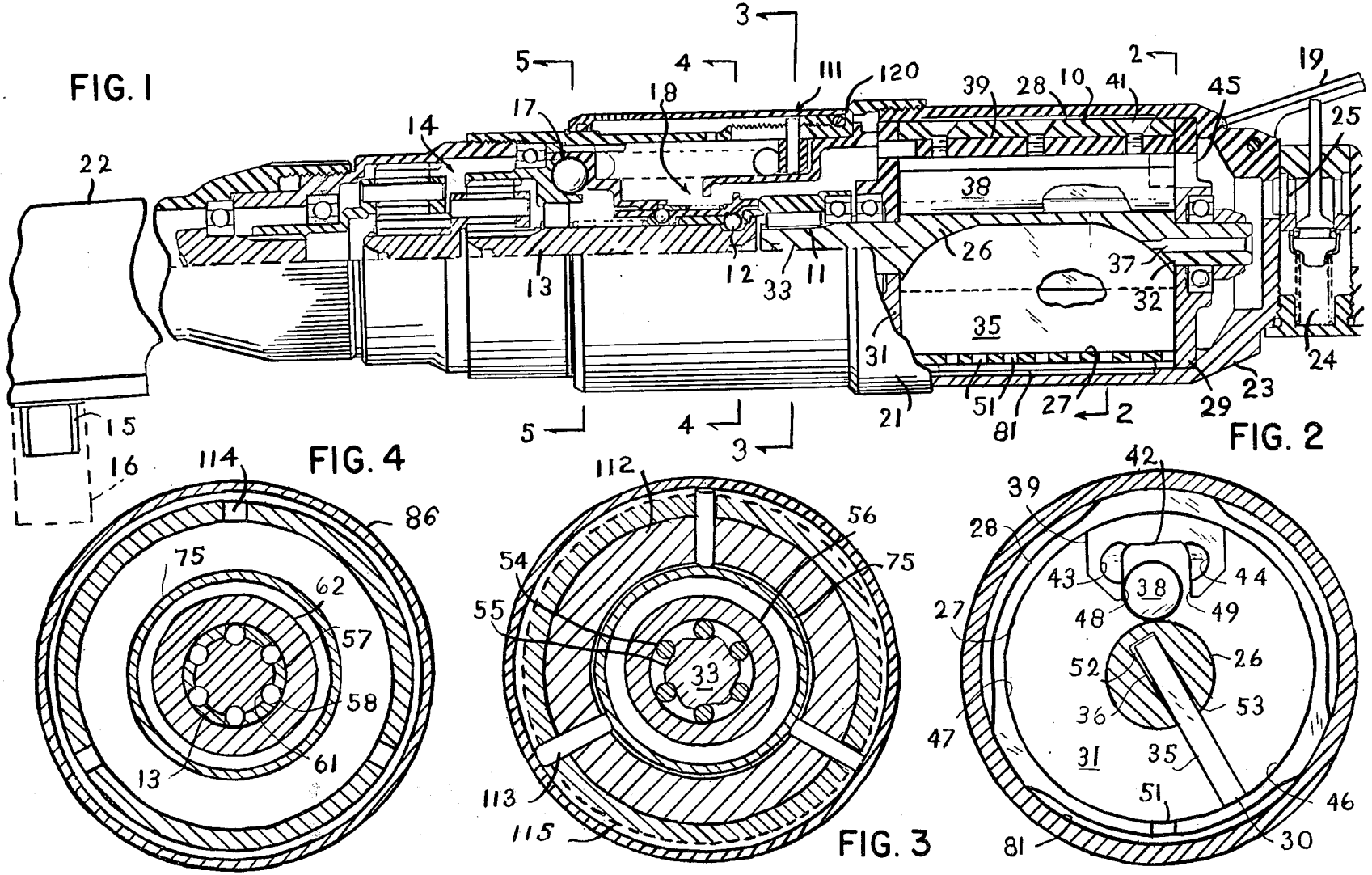
FIG. 1 is a view partially in longitudinal section of a pneumatically powered nut running tool of the non-impacting type embodying the invention.
FIG. 2 is a section on line 2—2 of FIG. 1.
FIG. 3 is a section on line 3—3 of FIG. 1.
FIG. 4 is a section on line 4—4 of FIG. 1.

The nut running tool shown in the drawing as embodying the invention is adapted by means of an air driven motor 10 to transmit in a forward direction a succession of torque pulses to a one-way clutch 11, which in turn transmits the pulses through a releasable ball latch connection 12 to a drive shaft 13. The latter connects by means of a train of reduction gearing 14 to a final drive spindle 15 carrying a wrench socket 16 engageable with the work, such as a nut or bolt head, to which the pulses are finally delivered.

Upon the work being torqued to a predetermined degree of tightness, a torque responsive cam clutch mechanism 17 responds to simultaneously actuate motor exhaust air shut-off mechanism 18 and to unlatch the one-way clutch 11 from the drive shaft 13, so as to cause stalling of the motor and simultaneous discontinuance of further torque delivery to the work. The tool is adapted to retain this inactive condition until the operator releases to closed condition a pressure air feed throttle valve 19, permitting the stalled condition of the motor to be relieved and permitting the one-way clutch to become re-latched to the drive shaft.

The components of the tool are supported in an elongate housing 21 having an angle head section 22 at its front end and a handle section 23 at its rear. The handle section provides an air inlet passage 24 which is connectible to an external source of pressure air.

The throttle valve 19 in the handle is manually operable to control flow of air from passage 24 to a downstream passage 25 leading to the air motor 10.

The motor (FIGS. 1, 2) includes a rotor 26 that is supported for rotation in a cylindrical chamber 27 defined by a liner 28 having open ends closed by a pair of end plates 29, 31. The support for the rotor is provided by stub end shafts 32, 33 thereof fitted in bearings mounted in the end plates. The end plates present bearing surfaces to corresponding end faces of the rotor.

The rotor is caused to be oscillated, or rotated forwardly and reversely for a limited angular distance in each direction upon application of inlet air pressure alternately to opposite faces of a blade 35 projecting radially from a slot 36 in the rotor. The blade is loosely disposed in the slot so as to permit it to have limited angular or tilting movement relative to the walls of the slot. The slot and blade are coextensive with the length of the rotor, and the ends of the blade have a bearing relation to the end walls of the rotor chamber.

Inlet air from passage 25 entering a duct 37 in the rotor's rear shaft 32 passes to the bottom of the rotor slot and pressures the blade outwardly to maintain its outer edge 30 in bearing relation to the cylindrical wall of the rotor chamber.

A cylindrical vane or roller 38 lying on the surface of the rotor is co-extensive with the latter, and has squared end faces in bearing relation to the end walls of the rotor chamber. A holder 39 fixed lengthwise of the rotor chamber by means of screws 41 has a longitudinally extending channel 42 of U-form in which the roller is loosely disposed. The channel is laterally widened adjacent its rear end by means of a pair of opposed grooves 43, 44. The rear open end of the channel as widened by the grooves registers with an air inlet port 45 in the rear end plate 29 connecting with the air feed passage 25.

The arrangement of the roller in conjunction with the rotor blade divides the rotor chamber 27 into a pair of expandible sub-chambers or cavities 46, 47; as best seen in FIG. 2. The roller is shiftable against one or the other side walls 48, 49 of the channel 42, as a consequence of pressure of inlet air building up in one or the other of the cavities. The roller in shifting acts in the manner of a valve so as to communicate the channel with one of the cavities and to seal it off from the other. The roller is formed of a resilient material enabling it to obtain a pressed sealing relation to the wall against which it is shifted.

A longitudinally extending row of exhaust ports 51 in the bottom of the liner allows escape of spent pressure air from one or the other of the cavities, accordingly as the rotor blade 35 obtains an angularly moved position in the rotor chamber to one or the other sides of the ports. The exhaust ports are centered along a line below the rotor in a plane common to the longitudinal axes of the rotor and channel 42.

In describing the mode of operation of the motor let it be assumed that the rotor blade 35 and the roller 38 have obtained the positions shown in FIG. 2, wherein the roller lies against the left wall 48 of channel 42, and the blade is to the right of the exhaust ports 51 and tilted forwardly in the rotor slot. Now, following manual opening of the throttle valve inlet air passes from passage 25 through the rotor shaft duct 37 to the area of the rotor slot 36 at the back of the blade to pressure the latter outwardly in bearing relation to the wall of the rotor chamber. Inlet air also passes from passage 25 through the end plate port 45 to channel 42 and flows through the clearance, presently at the right of the roller, to the right cavity 46. The latter cavity being presently unvented, that is not exposed to the exhaust ports 51, air pressure builds up therein to pressure the roller into sealing relation with the left wall 48 of channel 42 and to pressure the blade to rotate the rotor in a forward direction. As the edge of the blade passes over the exhaust ports 51, air pressure in cavity 46 is rapidly vented or dumped. The inertia of the rotor, however, carries the blade angularly a further short distance beyond the exhaust ports sufficiently to cause the blade to tilt in the opposite or reverse direction to that shown in FIG. 2 so that the blade portion within the slot abuts against the diagonally opposite areas 52, 53 of the slot. As the blade is shifting its tilted position, inlet air from the rotor slot flows over both sides of the blade to both cavities. That air flowing to the now vented right cavity 46 is exhausted; and the pressure of the air flowing to the left cavity 47 acts upon the roller to shift it to the opposite right wall 49 of channel 42.

Inlet air from channel 42 now flows to the left cavity 47 through the clearance created at the left of the shifted roller. Pressure now builds up in the left cavity forcing the blade and rotor angularly in a reverse direction. As the blade passes over the exhaust ports, the air pressure in the left cavity 47 is dumped through the exhaust ports and, as the blade is carried a further short distance by the inertia of the rotor it is caused to shift its tilted position back to that shown in FIG. 2. In the process of shifting of the blade, air from the rotor slot now acts in cavity 46 to shift the roller back to the position shown in FIG. 2.

This oscillating or alternate limited angular forward and reverse action of the rotor continues until the operator releases the throttle valve to closed condition. The extent of angular movement of the rotor and blade in either a forward or reverse direction is here approximately 60°.

The one-way clutch 11 functions to transmit to the drive shaft 13 only the torque pulses developed by the intermittent forward movements of the rotor. In turn, the drive shaft transmits the pulses through the train of reduction gearing 14 to the work.

Figure 6:
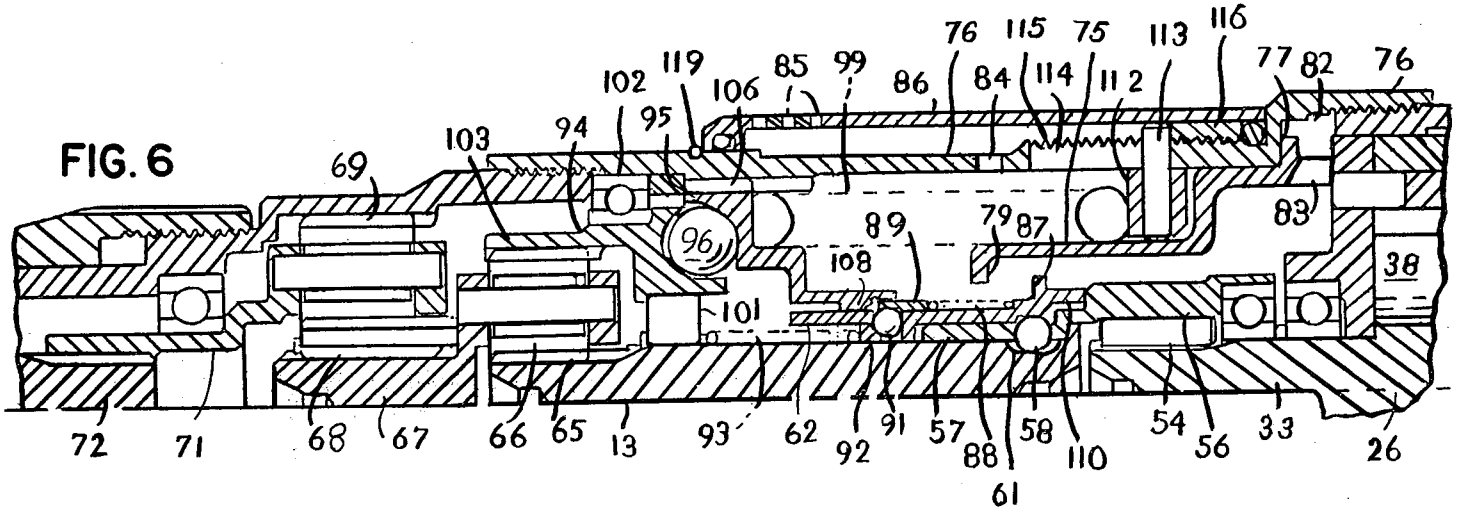
FIG. 6 is an enlarged view of the central portion of FIG. 1 for added clarity.
Figure 5:
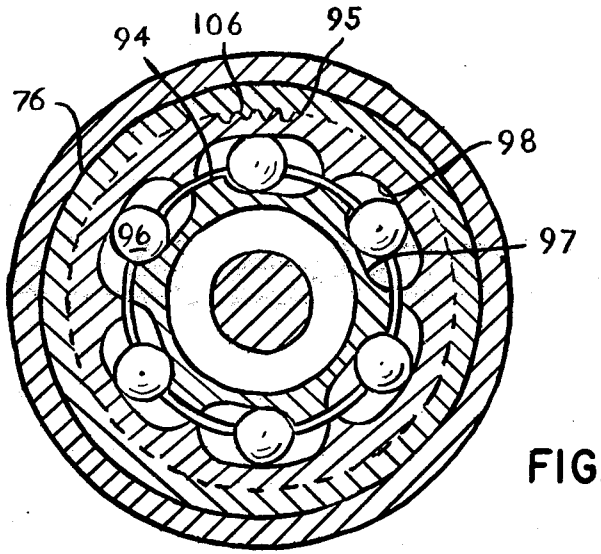
FIG. 5 is a section on line 5—5 of FIG. 1.
Figure 11:
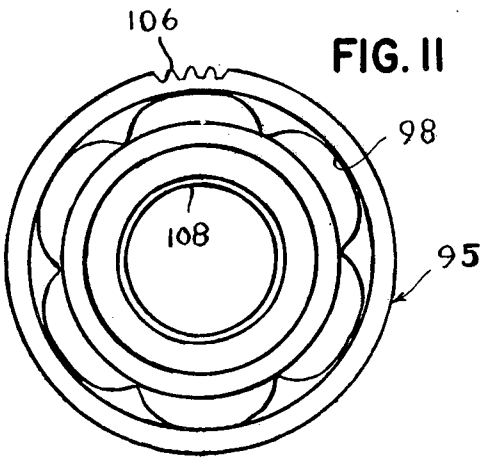
FIG. 11 is a left end view of FIG. 10.
Figure 9:
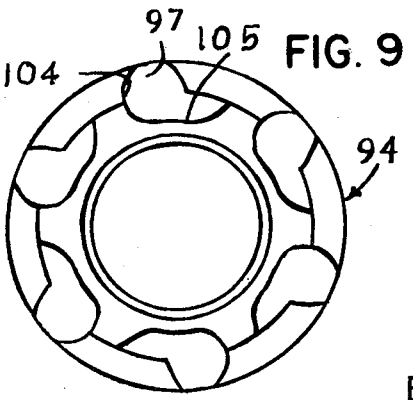
FIG. 9 is a right end view of FIG. 8.
Figure 10:
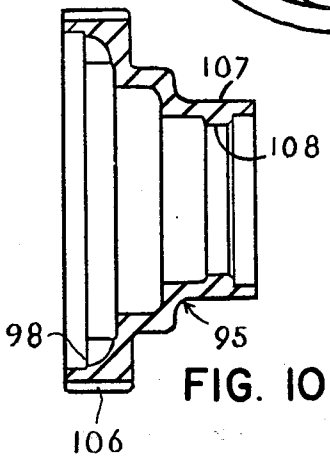
FIG. 10 is a longitudinal section through the slide clutch member.
Figure 8:
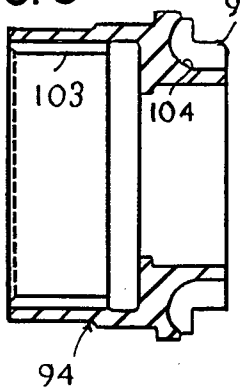
FIG. 8 is a longitudinal section through the torque sensing clutch member.
Figure 7:
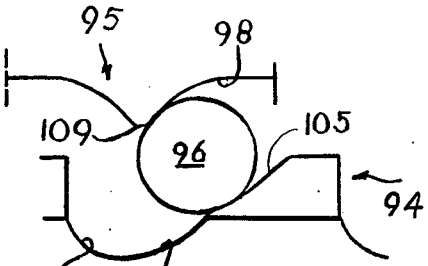
FIG. 7 is a development view of the cam profiles of the torque responsive release clutch.
Figure 12:
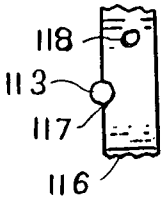
FIG. 12 is a fragmentary detail of the adjusting nut.

The one-way clutch 11, as best seen in FIGS. 1, 3, and 6, includes a group of circumferentially spaced clutch rollers 54, each of which is disposed between an individual wedge cam surface 55 on the rotor shaft 33 and a surrounding annular surface of a clutch sleeve member 56. A forward extension 57 of the clutch sleeve surrounds a rear portion of drive shaft 13, and is normally drivingly locked to the latter by means of the releasable ball latch connection 12.

The ball latch connection 12, as best seen in FIGS. 1, 4, and 6, includes a group of circumferentially spaced latch balls 58 projecting in part from individual radial holes in the clutch sleeve extension 57 into individual dished pockets 61 about the drive shaft. The pockets are shallow in that they have a lesser radial depth than the radius of the balls. The balls are releasably retained in the pockets by means of a surrounding axially slidable ball retaining sleeve 62.

It can be seen from the structure of the one way clutch 11 that when the rotor shaft 33 rotates clockwise (FIG. 3) in a forward direction, the outwardly inclined portions of the wedge cam surfaces 55 move under the rollers 54 to wedge them in the narrow spacing between the rotor shaft and the clutch sleeve, thus locking the latter drivingly to the rotor shaft. The forward drive of the rotor shaft 33 is then transmitted through the clutch sleeve 56 and the ball latch 12 to the drive shaft 13.

When the rotor shaft 33 is next rotated counterclockwise in a reverse direction, the inclined portions of the wedge cam surfaces 55 move away from the rollers 54, permitting the rollers to obtain an unlocked condition relative to the clutch sleeve in the deeper pocket ends of the wedge cam surfaces, as shown in FIG. 3. In the latter position the rollers have a bearing relation to the clutch sleeve, permitting the rotor shaft 33 to rotate in a reverse direction relative to the clutch sleeve. The load of the connected gear train 14 and the drive shaft 13 upon the clutch sleeve 56 is adequate to restrain the latter from being frictionally rotated in the reverse direction with the rotor shaft.

The drive shaft 13 has a splined driving connection at 65 with a group of idler gears 66 carried by a spindle 67 of a first stage of the reduction gearing 14. Spindle 67 in turn has a splined driving connection at 68 with idler gears 69 carried by a spindle 71 of a second stage of reduction gearing. Spindle 71 in turn has an internal splined driving connection with a shaft 72 connected in the angle head-housing section 22 with the final drive spindle 15. The latter has an external squared end carrying the wrench socket 16 adapted for engagement with the work, such as a nut or bolt head.

In the operation of the tool, torque pulses delivered by the rotor are transmitted through the described drive train to progressively run down the work. When the work has been torqued to a predetermined final degree of tightness, the torque responsive cam mechanism 17 responds automatically to actuate the motor exhaust air shut-off mechanism 18 to block escape of exhaust air from the rotor chamber 27 so as to cause the rotor to stall by the resultant back pressure. In this action the mechanism 17 also acts to unlatch or disable the one-way clutch 11 relative to the drive shaft 13 so as to terminate further torque delivery to the work.

The exhaust air shut-off mechanism 18, as best seen in FIGS. 1 and 6, includes an annular valve case 75 having a rear annular end held in rigid abutment with the motor front end plate 31 by means of an internal shoulder of a coupling section 76 of the housing drawn against a peripheral shoulder on the valve case, as at 77. The valve case has an axial exhaust opening at its forward end through a valve seat 79 defined by an inturned annular flange.

Exhaust air escaping from the rotor chamber 27 through the exhaust ports 51 passes through surface grooves at 81 in the liner, and in the front end plate 31 to an annulus 82 connecting through a group of ports 83 with the interior of the valve case. Exhaust air entering the valve case passes through the normally open valve seat 79 and escapes through ports 84 in the coupling 76 to final vents 85 in a surrounding exhaust deflector 86.

The valve seat 79 is disposed in coaxial surrounding spaced relation to the ball retaining sleeve 62. The latter has an axial sliding relation to the extended portion 57 of the clutch sleeve, and it projects in part forwardly out of the valve case and in part into the valve case. An exhaust valve defined by a lip 87 around the periphery of the ball retaining sleeve is cooperable with the valve seat to shut-off exhaust of air from the valve case so as to cause resulting back pressure of exhaust air developing in the rotor chamber to stall the rotor.

The ball retaining sleeve 62 is maintained under the load of a compression spring 88 in a normal rearward position on the clutch sleeve 56, in which position the valve 87 is held clear of its seat so as to allow escape of exhaust air from the valve case. In this normal position the rear end of the ball retaining sleeve 62 abuts a shoulder on the clutch sleeve; and its inner surface bears upon the latch balls 58 so as to retain them in driving engagement with the pockets 61 of the drive shaft 13.

The compression spring 88 is limited between a shoulder of the ball retaining sleeve and an opposed end of slidable locking ball release ring 89. The latter has a relieved forward inner diameter which overlies and abuts against a group of locking balls 91 individually disposed in circumferentially spaced holes in the ball retaining sleeve 62. The balls are pressured at their undersides upwardly against the release ring by means of ring wedge 92. The latter is slidable on the drive shaft 13, and has an angled face pressing under the load of a compression spring 93 angularly upward against the balls.

The torque responsive cam mechanism 17 is cooperable with the ball retaining sleeve 62 to effect closing of the exhaust valve 87 and unlatching at 12 of the one-way clutch 11 from the drive shaft 13.

The torque responsive cam mechanism 18 (FIGS. 1, 5-11) includes a torque sensing cam clutch member 94, and an opposed slide cam clutch member 95. A group of camming balls 96 seated in individual cam troughs 97, 98 formed in opposite end faces of the clutch members provide clutched engagement of the clutch members under the load of a clutch spring 99 acting on the slide clutch member.

The sensing clutch member 94 has an annular body supported between inner and outer bearings 101, 102; and is restrained by the bearings against relative axial movement. It is formed in its forward end with an internal ring gear 103 engaged with the idler gears 66 of the first gear reduction stage. The profile of the cam troughs 97 in its rear face, as best seen in FIGS. 5, 7–9, includes pocket portions 104 in which the balls 96 are normally seated, and ramp portions 105 up which the balls are adapted to ride as the sensing clutch member reacts angularly to a predetermined torque overload or reaction from the work.

The slide clutch member 95 has an annular body splined at 106 to the housing section 77 for relative axial movement. The profile of the cam troughs 98 in its end face is best shown in FIGS. 5, 7, 10, 11. Clutch member 95 has at its rear an axially extending annular tail portion 107 provided with an internal annular rib 108 that bears upon the ball retaining sleeve 62 slightly forwardly of the locking balls 91.

During initial run down of the work the clutch balls 96 in the normally clutched condition of the clutch members 94, 95 under the spring load 99 cooperate with the end walls of the cam pockets 104 to restrain the sensing clutch member 94 substantially stationary against rotation with the idler gears 103. But, as the work approaches a final torqued condition, increasingly developing torque reaction acts through the reduction gearing to force the sensing clutch member angularly relative to the idler gears and to the slide clutch member so as to force the balls 96 out of the cam pockets 104 up the ramp portions 105 and toward the peaks 109 of the opposing cam troughs in the slide clutch member 95. In this action the slide clutch member is forced or cammed by the balls axially rearward.

In the rearward movement of the slide clutch member a rear shoulder of its internal rib 108 rides over the locking balls 91 forcing them inwardly of their holes against the yieldable spring biased ring wedge 92; and at the same time abuts the latch ball release ring 89 forcing it clear of the locking balls against the resistance of spring 88. With continued rearward movement of the slide clutch member its rib 108 eventually rides clear of the locking balls, whereupon the latter are forced by the spring loaded ring wedge 92 upwardly in their holes to protrude in front of a forward shoulder of the rib so as to lock the ball retaining sleeve 62 to the slide clutch member.

At about the time of the latter action the clutch balls 96 will have obtained an unstable angular position between the cam surfaces of the angularly moved sensing clutch member and the axially moved slide clutch member so as to cause the balls to sharply slip or squirt back into the cam pockets 104.

The slide clutch member returns forwardly in the latter action under the load of the clutch spring 99. In its forward movement it drags the ball retaining sleeve 62 with it to close the exhaust valve 87 upon its seat 79.

This blocks escape of exhaust air from the rotor chamber and results in back pressure causing the rotor to stall; and it brings a relieved rear area 110 of the ball retaining sleeve 62 over the balls 58 of the one-way clutch 11 so as to permit the latter balls to rise out of their shallow pockets sufficiently to release or disable the driving connection of the one-way clutch from the drive shaft 13.

The forward travel of the ball retaining sleeve 62 by the slide clutch member is stopped by the seating action of the valve, but the forward movement of the slide clutch member continues. As it does so the forward shoulder on its rib portion 108 forces the locking balls 91 back down into the holes in the ball retaining sleeve against the force of the spring loaded ring wedge 92. This allows spring 88 to return the release ring 89 into overlying relation to the locking balls 91.

The tool remains in this stalled and disconnected or disabled drive condition until the operator closes the throttle valve. This allows the trapped exhaust air pressure in the valve case 75 behind the valve to bleed off, permitting the springs 93, 88 to return the ball retaining sleeve 62 together with the exhaust valve 87 thereon to original position. The tool will then be in normal condition to repeat the cycle.

It is apparent that the torque responsive cam clutch mechanism 17 controls the valve of torque delivery to the work. Adjusting means 111, is provided for regulating the torque value to which the cam clutch is to respond. This means, as best seen in FIGS. 1, 3, 6 and 12, includes an abutment ring 112 which surrounds a reduced diameter forward portion of the valve case 75 and abuts against the rear end of the clutch spring 99. A group of circumferentially spaced pins 113, here three in number, project radially from the abutment ring through longitudinally extending guide slots 114 of the housing section 77 and protrude beyond a threaded surface 115 of the housing. An adjusting ring nut 116 threaded on the housing rearwardly of the protruding portions of the pins abuts against the latter. It can be seen that clockwise adjustment of the ring nut will slide the pins 113 and the ring 112 forwardly to increase the spring load upon the clutch so as to increase the delivered torque value to which the clutch will respond; and that counter-clockwise adjustment of the ring nut will effect a decrease in the spring load on the clutch.

Notches 117 (FIG. 12) formed on the forward wall of the adjusting nut are designed for engagement with the pins so as to retain the adjusting nut and the abutment ring against release from an adjusted position under the usual vibratory forces accompanying the operation of the tool. So as to permit a reasonable degree of variation in selective adjustments of the ring nut and yet obtain a latched adjusted condition of the ring nut, the notches are here six in number and spaced circumferentially equally apart.

Holes 118 spaced circumferentially about the periphery of the adjusting nut enable application of a suitable manually operable prong wrench to effect angular adjustments of the nut.

The exhaust deflector 86 surrounds the housing so as to protectively cover over the adjustment means against entry of dirt, damage, or accidental release. The exhaust deflector has a sliding relation to the housing. In its normal covering position, as in FIG. 1, 6, its rear end abuts against a housing shoulder at 120, and its forward end abuts against a removable retaining ring 119. The housing is reduced in its forward diameter for a distance sufficiently to allow, following removal of the retaining ring 119, sliding of the exhaust deflector sufficiently to uncover the adjusting means for purposes of adjustment.

It is to be appreciated from the foregoing that an air powered nut running tool of an overall improved nature is provided. Its power is delivered to the work in pulses enabling the tool's inertia to average the reaction pulses transmitted to the operator. The tool's output torque is controlled by a cam clutch, which is designed to reduce torque inaccuracies that result from variations, such as in work torque rates, supply pressure, motor lubrication, motor wear, and so on. Stalling of the motor and discontinuance of torque transmission are timed to occur substantially simultaneously whereby strain upon various components, as well as torque reaction to the operator, that might otherwise occur upon the work reaching final torque, are minimized.

I claim:

1. A pneumatically powered nut running tool comprising an air driven torque pulse transmitting motor having a rotor operable in a chamber, an air exhaust passage connected for exhausting spent air from the chamber, a valve in the exhaust passage controlling escape of spent air from the chamber having a normally open condition, a spindle connectible with an article to be torqued, a drive train connecting the rotor with the spindle including reduction gearing, clutch means in the drive train adapted to transmit torque pulses from the motor only in a forward direction to the spindle, releasable latch means in the drive train adapted when released to disable the drive train from transmitting further torque pulses to the spindle, and torque responsive cam means connected to the reduction gearing responsive to a predetermined torque overload developing in the reduction gearing to cause closing of the valve and release of the latch means.

2. A pneumatically powered nut running tool as in claim 1, wherein the rotor includes an output shaft and the clutch means is a one-way roller clutch comprising the rotor output shaft as a driving member, a clutch sleeve in surrounding spaced relation to the output shaft as a driven member, roller elements between the output shaft and the sleeve, and wedging surfaces on the output shaft cooperable with the roller elements to transmit the output of the rotor in a forward direction to the clutch sleeve.

3. A pneumatically powered nut running tool as in claim 2, wherein the drive train includes a drive shaft, an extension of the clutch sleeve surrounds a rear end of the drive shaft, and the latch means releasably engages the extension of the clutch sleeve drivingly with the drive shaft.

4. A pneumatically powered nut running tool as in claim 3, wherein the latch means includes a group of circumferentially spaced holes in the extension of the clutch sleeve, a corresponding group of pockets in the drive shaft, a latch ball seated in each pocket and projecting in part in the holes, a ball retaining sleeve surrounding the extension of the clutch sleeve in overbearing relation to the balls retaining them in the pockets and in the holes so as to drivingly interlock the clutch sleeve with the drive shaft, and spring means normally maintaining the ball retaining sleeve in said overbearing relation.

5. A pneumatically powered nut running tool as in claim 4, wherein the ball retaining sleeve has an enlarged inner diameter rear portion normally disposed on the clutch sleeve just rearwardly of the balls in a rearward position of the ball retaining sleeve, and the ball retaining sleeve is axially slidable forwardly on the clutch sleeve against the force of the spring means so as to position its enlarged inner diameter over the balls to cause disabling of the balls therein from maintaining their locking driving relation with the pockets of the drive shaft.

6. A pneumatically powered nut running tool as in claim 5, wherein the exhaust passage is defined by a case communicating with the rotor chamber and having an open forward end defining a valve seat in coaxial surrounding spaced relation to the ball retaining sleeve, the valve is a lip about the periphery of the ball retaining sleeve having in the rearward position of the ball retaining sleeve a normal position spaced rearwardly from the valve seat in open condition.

7. A pneumatically powered nut running tool as in claim 6, wherein the valve is adapted to be carried closed upon the valve seat upon forward movement of the ball retaining sleeve against the force of the spring means.

8. A pneumatically powered nut running tool as in claim 7, wherein the inner diameter of the ball retaining sleeve and the valve on the latter are so positioned in the rearward position of the ball retaining sleeve that upon forward axial movement of the latter the valve is adapted to engage the seat and substantially simultaneously therewith the said inner diameter is adapted to be positioned over the balls.

9. A pneumatically powered nut running tool as in claim 8, wherein the torque responsive cam means is a torque separable cam clutch comprising a torque sensitive part having a ring gear engagement with the reduction gearing, a slide part axially slidable relative to the sensitive part, a clutch spring pressing the slide part axially into clutched engagement with the sensitive part, cam means on the slide part, camming means on the sensitive part cooperable with the cam means on the slide part to cam the latter axially against the load of the clutch spring upon the sensitive part realizing a predetermined torque load, and the clutch spring load is adapted following a predetermined degree of axial separation of the slide part to return the latter into clutched engagement, latch means on the slide part is cooperable with spring loaded ball means on the ball retaining sleeve during separation of the slide part from the sensitive part to latch onto the ball retaining sleeve, and the slide part is adapted on being returned into clutched engagement to carry the ball retaining sleeve forwardly so as to close the valve upon the valve seat and to position the inner diameter of the ball retaining sleeve over the latch balls.

10. A pneumatically powered nut running tool as in claim 9, wherein torque adjusting means accessible from externally of the tool is provided for adjusting the load of the clutch spring upon the slide part.

11. A pneumatically powered nut running tool as in claim 10, wherein the torque adjusting means includes a slidable ring abutting a rear end of the clutch spring, a group of pins projecting radially from the slidable ring and extending through to the outside of longitudinally extending guide slots in a threaded surface of the housing of the tool, an adjusting nut threadedly adjustable along the threaded surface against the pins so as to move the pins along the guide slots and as a consequence move the slidable ring axially relative to the clutch spring.

12. A pneumatically powered nut running tool as in claim 11, wherein holes are provided in the periphery of the adjusting nut for application of a torquing wrench to the latter.

13. A pneumatically powered nut running tool as in claim 12, wherein notches spaced about a forward wall of the adjusting nut are releasably engagable with the pins in predetermined angular adjustments of the nut so as to fix the adjusted position of the slidable ring.

14. A pneumatically powered nut running tool as in claim 13, wherein an axially slidable cover on the housing protectively covers over the torque adjusting means, and is manually slidable along the housing to expose externally the torque adjusting means for purposes of adjustment.

15. A pneumatically powered nut running tool as in claim 1, wherein the motor comprises a liner in the housing of the tool defining a cylindrical wall of the chamber, a pair of bearing plates closes opposite ends of the chamber, the rotor has oppositely extending stub shafts supported in the bearing plates for rotation of the rotor in the chamber, one of the bearing plates communicates the chamber with a source of live air, a blade coextensive with the rotor projects radially from the latter into bearing relation with the cylindrical wall, and means is provided for causing live air passing through the one bearing plate to be applied alternately to and vented from areas of the chamber at opposite sides of the blade so as to cause the rotor to oscillate about its axis forwardly and reversely.

16. A pneumatically powered nut running tool as in claim 15, wherein the chamber includes a row of exhaust ports through the liner in a line parallel to the longitudinal axis of the rotor, the exhaust ports being adapted to vent that area of the chamber of live air being applied to the blade upon the blade passing angularly over the exhaust ports.

* * * * *